US005435078A

United States Patent [19]

Pyle

[11] Patent Number: 5,435,078

[45] Date of Patent: Jul. 25, 1995

[54] SHOE SUSPENSION SYSTEM

[75] Inventor: Clifford L. Pyle, Cincinnati, Ohio

[73] Assignee: The United States Shoe Corporation, Cincinnati, Ohio

[21] Appl. No.: 275,366

[22] Filed: Jul. 15, 1994

[51] Int. Cl.[6] ..... A43B 13/12; A43B 13/16

[52] U.S. Cl. ..... 36/30 R; 36/28; 36/31

[58] Field of Search ..... 36/28, 30 R, 25 R, 30 A, 36/32 R, 44, 181, 178, 31

[56] References Cited

U.S. PATENT DOCUMENTS

| | | | |
|---|---|---|---|
| 2,222,391 | 11/1940 | Andreasen | 36/30 A |
| 2,348,336 | 5/1944 | Everston . | |
| 3,766,669 | 10/1973 | Pearsall . | |
| 3,971,145 | 7/1976 | Stegerwald . | |
| 4,043,058 | 8/1977 | Hollister et al. | 36/28 |
| 4,128,950 | 12/1978 | Bowerman et al. . | |
| 4,316,332 | 2/1982 | Giese et al. . | |
| 4,316,335 | 2/1982 | Giese et al. . | |
| 4,364,188 | 12/1982 | Turner et al. | 36/30 R |
| 4,398,357 | 8/1983 | Batra . | |
| 4,399,620 | 8/1983 | Funck . | |
| 4,463,505 | 8/1984 | Duclos . | |
| 4,481,726 | 11/1984 | Phillips . | |
| 4,551,930 | 11/1985 | Graham et al. | 36/30 R |
| 4,564,966 | 1/1986 | Chen . | |
| 4,624,061 | 11/1986 | Wezel et al. | 36/30 A |
| 4,641,438 | 2/1987 | Laird et al. . | |
| 4,667,423 | 5/1987 | Autry et al. . | |
| 4,674,204 | 6/1987 | Sullivan et al. | 36/44 |
| 4,676,010 | 6/1987 | Cheskin . | |
| 4,757,620 | 7/1988 | Tiitola . | |
| 4,760,652 | 8/1988 | Austin . | |
| 4,866,860 | 9/1989 | Buissett et al. | 36/25 R |
| 4,897,936 | 2/1990 | Fuerst | 36/30 A |
| 4,900,490 | 2/1990 | Kozma | 36/28 |
| 5,025,573 | 6/1991 | Giese et al. . | |
| 5,077,915 | 1/1992 | Gross | 36/28 |
| 5,163,237 | 11/1992 | Rosen . | |
| 5,174,049 | 12/1992 | Flemming . | |
| 5,245,766 | 9/1993 | Warren | 36/28 |

FOREIGN PATENT DOCUMENTS

| | | | |
|---|---|---|---|
| 665051 | 8/1938 | Germany | 36/30 R |

*Primary Examiner*—Steven N. Meyers
*Attorney, Agent, or Firm*—Laubscher & Laubscher

[57] ABSTRACT

A suspension system for shoe soles includes an insole mounted on the upper surface of an outsole and containing shock absorbing inserts in forepart and heel areas thereof. The forepart insole insert comprises a shock foam and the heel insole insert comprises polyurethane. Above the forepart area of the insole is provided a midsole containing a polyurethane shock absorbing insert which abuts against the foam insert in the insole to increase the cushioning effect on the forepart area of the foot. A two-layer socklining completes the suspension system. It includes a lower layer of shock absorbing foam and an upper cover of coagulated urethane. The socklining completely covers the footbed. The suspension system provides greater comfort, shock absorption, and cushioning to the wearer and is particularly suitable for women's dress and casual shoes.

4 Claims, 4 Drawing Sheets

SHOE SUSPENSION SYSTEM

BACKGROUND OF THE INVENTION

Women have long suffered from uncomfortable dress shoes. In order to incorporate stylish features into such shoes, it has been necessary to construct the shoes of rigid durable materials to provide a high degree of support with a minimal amount of material. Recent developments in outsole materials and shock absorbing foam materials have been incorporated into athletic footwear but not in dress shoes because of the difficulties in providing such features in a shoe which is still stylish for dress wear or casual wear.

BRIEF DESCRIPTION OF THE PRIOR ART

One way of improving the comfort of footwear is to use flexible outsoles and layered socklinings as the sole construction for the footwear. For example, the U.S. Pat. Nos. to Austin No. 4,760,652 and Cheskin No. 4,676,010 disclose composite outsoles which are flexible and resilient and thus suitable for use with athletic footwear. A major drawback of these prior composite outsoles is that they lack the rigidity and durability necessary for streetwear.

Efforts to improve the comfort of footwear include providing padded soles as shown in the Funck U.S. Pat. No. 4,399,620. Unfortunately, as a result of extended use, the padding of the sole becomes permanently compressed by the weight of the wearer so that the cushioning properties of the foam diminish over time. This is particularly true in the heel area of the shoe sole.

The present invention was developed in order to overcome these and other drawbacks of the prior sole constructions by providing a layered cushioning suspension system for women's dress and casual shoes.

SUMMARY OF THE INVENTION

Accordingly, it is a primary object of the present invention to provide a shoe suspension system for supporting and cushioning the foot of the wearer. The suspension system includes an insole mounted on an upper surface of the shoe outsole and having forepart, arch, and heel areas which extend over corresponding areas of the outsole. The forepart and heel areas of the outsole contain openings within which are arranged shock-absorbing inserts. A midsole is mounted on the forepart area of the insole and also contains an opening for receiving a further shock-absorbing insert. A socklining covers the midsole and the insole and comprises a lower layer of shock-absorbing foam and a flexible cover layer.

The socklining foam layer and the inserts in the forepart area of the insole both comprise a closed cell vinyl nitrile foam material which resists permanent compression. The inserts in the heel area of the insole and in the midsole are formed of a polyurethane material.

In order to stabilize the shoe and the outsole, a contoured rigid heel tuck is mounted between the outsole and the insole between the heel and arch areas of the outsole. A steel rod is connected with the heel tuck to provide arch support and stability in the heel area of the shoe.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
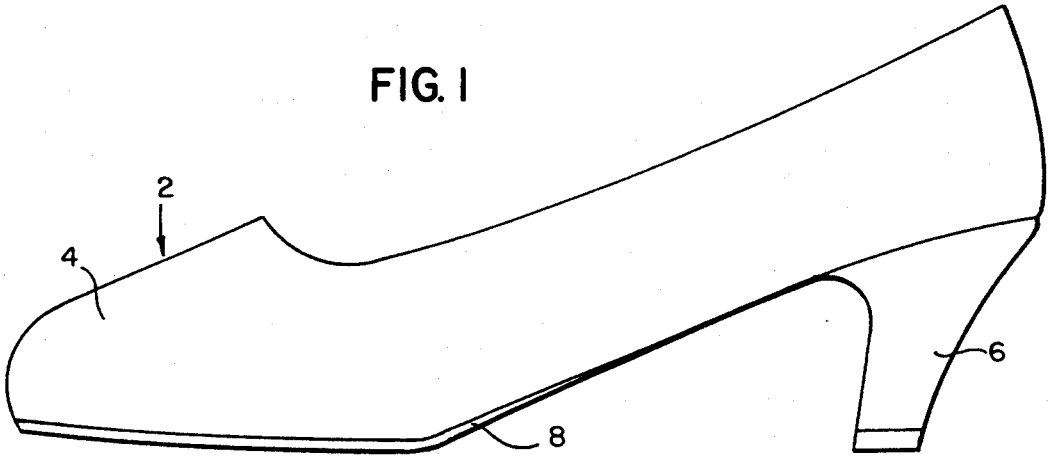
FIGS. 1 and 2 are side views of two different shoe styles incorporating the suspension system of the invention.
Figure 2:
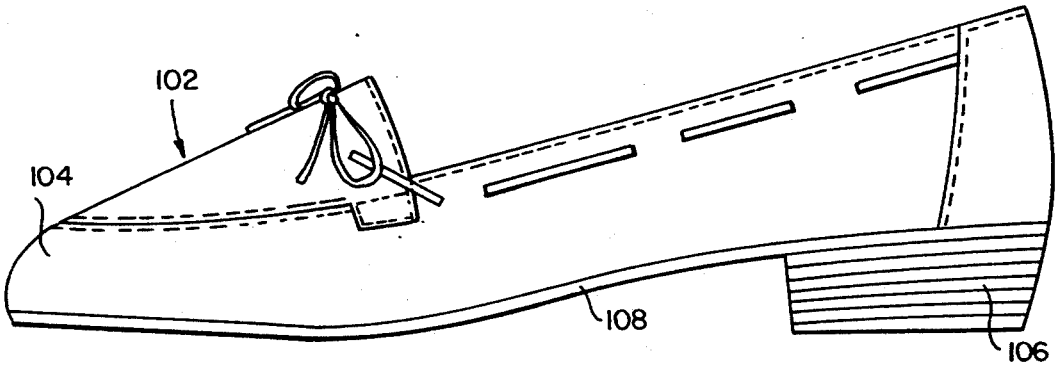

There is shown in FIG. 1 an article of footwear such as a woman's dress shoe 2 including an upper 4, a heel 6, and the sole construction 8 of the invention. The upper 4 is conventional and comprises a soft and supple nappa kidskin leather for a tailored look and comfort for the wearer. In FIG. 2 is shown a woman's casual shoe 102 including an upper 104, a heel 106 and a sole construction 108.

Figure 3:
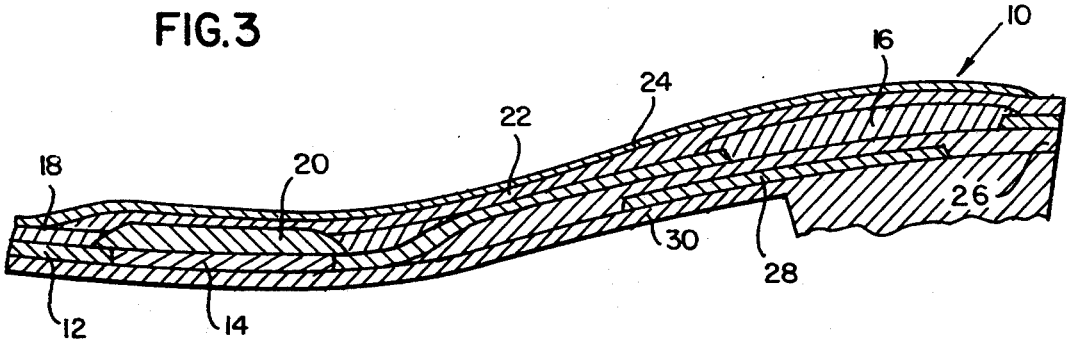
FIG. 3 is a side sectional view of a shoe sole showing the layered suspension system of the invention.

The sole constructions 8, 108 of the shoes of FIGS. 1 and 2 both include the new suspension system 10 of the invention which will be described with reference to FIGS. 3–18. FIG. 3 is a sectional view of a shoe sole showing the various layers of the suspension system 10. The lowermost layer of the suspension system is an insole 12 containing a first insert 14 in the forepart area and a second insert 16 in the heel area thereof. Above the forepart area of the insole is a midsole 18 which contains a third insert 20. A socklining comprising a lower foam layer 22 and an upper cover layer 24 completes the suspension system. As will be developed below, a rigid heel tuck 26 including a reinforcing steel rod 28 are provided over the heel and arch areas of the shoe between an outsole 30 and the insole 12.

The elements of the suspension system will now be described in greater detail.

Figure 4:
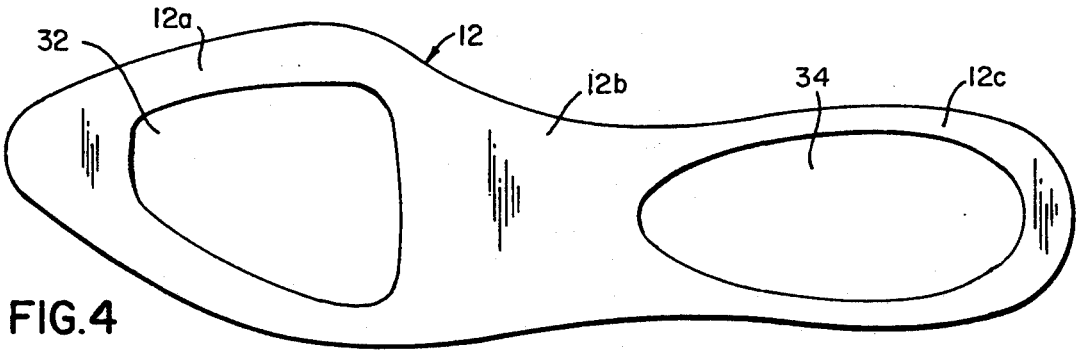
FIGS. 4 and 5 are top plan and side sectional views, respectively, of the insole according to the invention.
Figure 5:
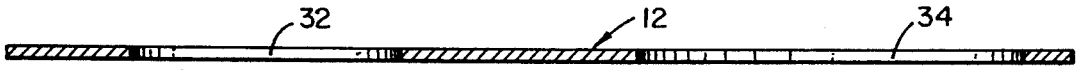
Figure 6:
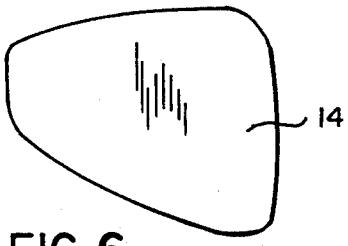
FIGS. 6 and 7 are top and side plan views, respectively, of an insert for the forepart area of the insole.
Figure 8:
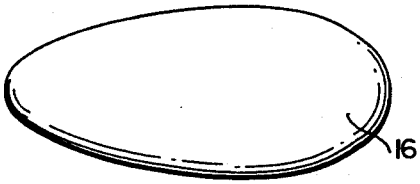
FIGS. 8 and 9 are top and side plan views, respectively, of an insert for the heel area of the insole.
Figure 7:
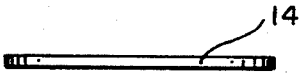
Figure 9:
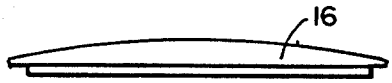

As shown in FIGS. 4 and 5, the insole 12 includes forepart **12*a*, arch 12*b*, and heel 12*c* areas so that the insole extends from the tip of the shoe to the heel. Preferably, it is fastened to the upper surface of the outsole 30 (which may be of any conventional construction) by a suitable adhesive. The insole is formed of a relatively flexible non-woven cellulose fiber material and the forepart area 12*a* of the insole contains a first opening 32 and the heel area 12*c* contains a second opening 34**.

Arranged, and preferably molded, within the opening 32 in the forepart area of the insole is the first insert 14 formed of shock-absorbing foam material such as 0.062 closed cell vinyl nitrile foam material which resists permanent compression. Such foam material is compressible but returns to its natural configuration when pressure, such as from the weight of the wearer, is removed. Thus, the foam conforms somewhat to the wearer's foot during use but resumes its regular state when not in use. A second insert 16 is molded and arranged within the opening 34 in the heel area of the insole. The second insert is formed of polyurethane material which cushions the heel of the wearer's foot during walking. The first and second inserts are shown in FIGS. 6–9.

Figure 10:
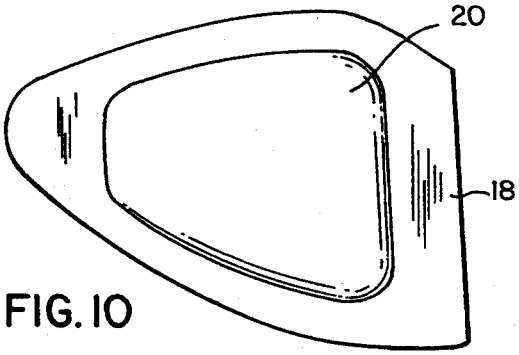
FIGS. 10 and 11 are top plan and side sectional views, respectively, of the midsole and midsole insert according to the invention.
Figure 11:
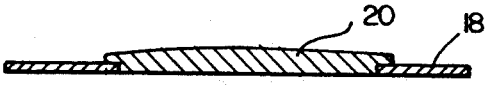
Figure 12:
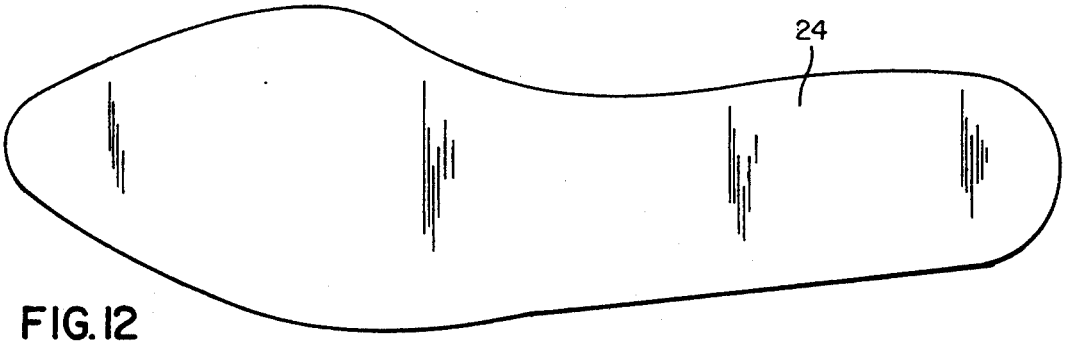
FIGS. 12 and 13 are top and side plan views, respectively, of a cover layer of the socklining of the invention.
Figure 13:
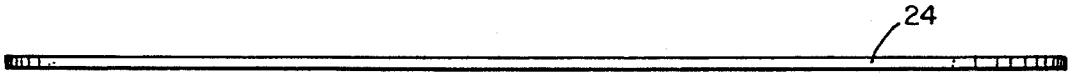
Figure 14:
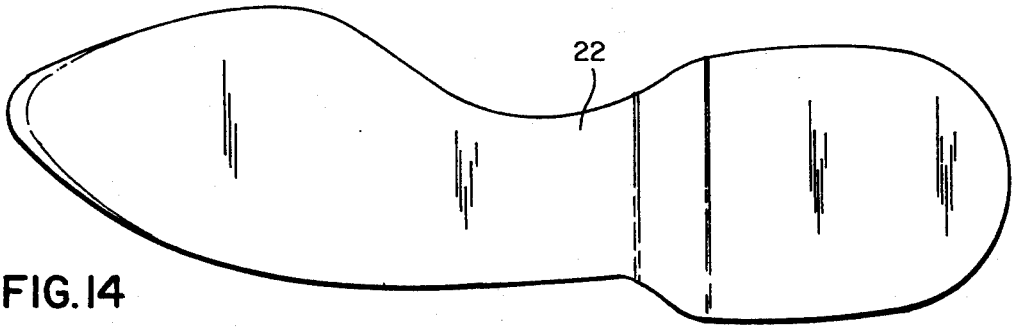
FIGS. 14 and 15 are top and side plan views, respectively, of a foam layer of the socklining of the invention.
Figure 15:
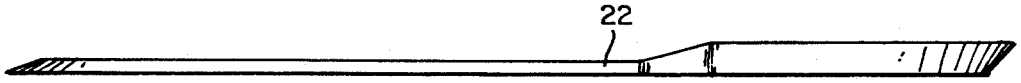

Above the insole forepart area and adhesively secured thereto is the midsole 18 containing an opening within which is arranged a shock absorbing polyurethane third insert 20 as shown in FIGS. 10 and 11. Like the insole, the midsole is formed of a non-woven cellulose fiber material. The forepart area of the wearer's foot is thus provided with two contiguous shock absorbing layers including the lower shock foam insert 14 and the upper polyurethane insert 20 as shown in FIG. 3.

Figure 16:
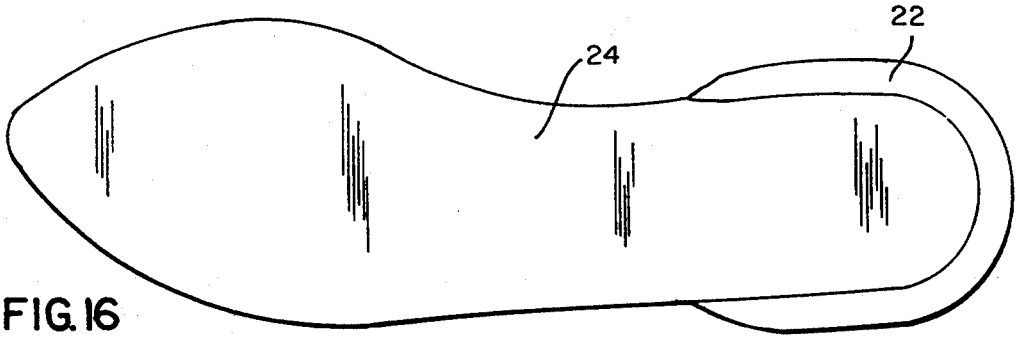
FIG. 16 is a top plan view of the assembled socklining of the invention.

Above the midsole 18 in the forepart area and the insole 12 in the arch and heel areas of the shoe sole is provided a continuous socklining which is adhesively connected with the midsole and the insole. As shown in FIGS. 12–16, the socklining includes an upper cover layer 24 formed of coagulated urethane and a lower shock-absorbing layer 22 formed of 0.110 closed cell vinyl nitrile shock foam. Around the periphery of the heel area, the foam layer 22 extends above and beyond the cover layer (as shown in FIG. 16) to increase the cushioning effect and support around the heel of the wearer.

Figure 17:
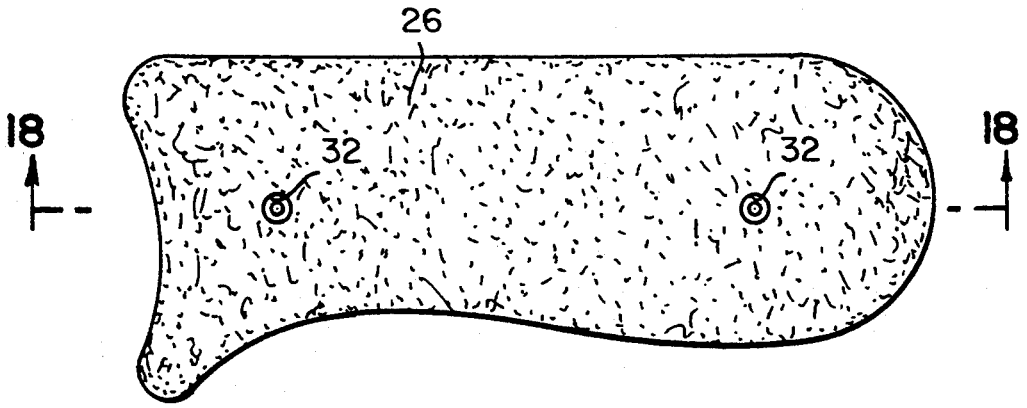
FIG. 17 is a top plan view of a heel tuck according to the invention.
Figure 18:
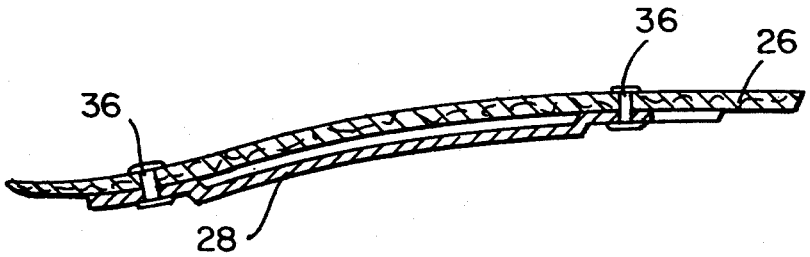
FIG. 18 is a sectional view taken along line 18—18 of FIG. 17.
Figure 19:
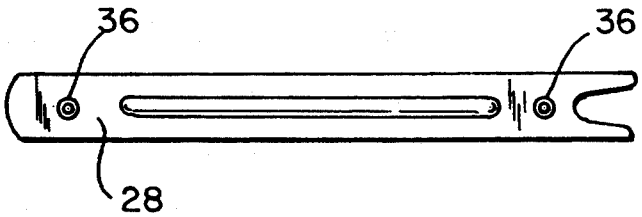
FIG. 19 is a bottom plan view of a steel rod attached to the heel tuck.

Owing to the provision of a heel in the shoes of FIGS. 1 and 2, it is necessary to provide support within the shoe sole. This support is provided by a rigid heel tuck 26 which is shown in FIGS. 17 and 18. The tuck includes heel and arch portions but not a forepart portion. It is mounted on the upper surface of the outsole over the heel and arch portions thereof. The tuck is preferably formed from a compressed fiberboard which is relatively light in weight. It is skived, beveled, and molded to the shape of the shoe last used in the shoe construction. In order to increase the rigidity of the tuck, a steel rod or shank 28 is secured to the lower surface of the tuck by rivets 36. The shank is shown in plan view in FIG. 19.

While in accordance with the provisions of the patent statute the preferred forms and embodiments of the invention have been illustrated and described, it will be apparent to those of ordinary still in the art that various changes and modifications may be made without deviating from the invention concepts set forth above.

What is claimed is:

1. A suspension system for providing cushioned support for the foot of the wearer on an outsole of a shoe, comprising (a) an insole adapted for mounting on an upper surface of the shoe outsole, said insole being formed from a non-woven cellulose fiber material and having forepart, arch, and heel areas extending over corresponding areas of the outsole, said forepart and heel areas containing openings;

(b) first and second shock-absorbing inserts arranged within said insole forepart and heel area openings, respectively;

(c) a midsole mounted on a forepart area of said insole, said midsole being formed of a non-woven cellulose fiber material and containing an opening;

(d) a third shock-absorbing insert arranged within said midsole opening;

(e) a socklining mounted on said midsole and said insole and extending over the forepart, arch and heel areas thereof, said socklining including a flexible cover layer and a lower layer of shock-absorbing foam; and (f) said first insert and said socklining foam layer being formed from a closed cell vinyl nitrile foam material which resists permanent compression and said second and third inserts being formed from polyurethane material.

2. A suspension system as defined in claim 1, wherein said socklining cover layer is formed of urethane.

3. A suspension system as defined in claim 2, and further comprising a contoured rigid heel tuck mounted between the outsole and said insole and extending over heel and arch areas of the outsole.

4. A suspension system as defined in claim 3, wherein said heel tuck includes a contoured steel rod connected with a lower surface thereof to provide arch support and stability in the heel area of the shoe.

* * * * *